United States Patent [19]

Reed

[11] 3,994,663

[45] Nov. 30, 1976

[54] METHOD AND APPARATUS TO PREVENT AIR FLOW INVERSION IN FLARE STACKS

[75] Inventor: Robert D. Reed, Tulsa, Okla.

[73] Assignee: John Zink Company, Tulsa, Okla.

[22] Filed: Nov. 28, 1975

[21] Appl. No.: 635,789

[52] U.S. Cl. ..... 431/5; 23/277 C; 431/202

[51] Int. Cl.[2] ..... F23D 13/20

[58] Field of Search ..... 431/5, 202, 29, 30, 431/31; 23/277 C

[56] References Cited

UNITED STATES PATENTS

| | | | |
|---|---|---|---|
| 3,578,892 | 5/1971 | Wilkinson | 431/202 |
| 3,741,713 | 6/1973 | Reed | 431/202 |
| 3,901,643 | 8/1975 | Reed et al. | 431/202 |

*Primary Examiner*—Edward G. Favors
*Attorney, Agent, or Firm*—Head, Johnson & Chafin

[57] ABSTRACT

Hazardous inversion of ambient air into a waste gas elevated flare stack is prevented by the controlled injection of a purge gas into the bottom of the stack. Upward or downward flow of gases in the stack deflects a small horizontal, high velocity stream of gas relative to opposite tubes capable of sensing the impact energy relative to differential pressure detection devices. The devices thus send a signal to control the quantity of purge gas input as a function of the deflection of the stream.

7 Claims, 9 Drawing Figures

METHOD AND APPARATUS TO PREVENT AIR FLOW INVERSION IN FLARE STACKS

BACKGROUND AND OBJECTS OF THE INVENTION

In refinery and petrochemical plants, gases are produced which, after processing in suitable blowdown recovery systems to retrieve condensates, are considered to be waste gases. These wastes usually represent a heterogeneous mixture of gases as a result of their having originated from a variety of sources such as hydrocarbon vapors from various leaks, or from venting unsafe operating pressures in process units during scheduled shutdowns and startups, or from certain plant failures which would cause sudden venting of gases. These large volumes of hydrocarbon gases produced in refinery plants are generally used as fuel or for raw material for further processing; however, sizeable quantities must be considered waste, and, after going through scubbers and knockout drums to gather condensates, it must be discarded as useless.

One common method used to dispense with waste gases includes use of vertical elevated flare stacks through which the gases are vented to atmosphere and ignited at the top by suitable pilot light means to produce burning in a smokeless flare. These flare stacks do not burn continuously but rather only as the upward flow of waste gases demands, controlled by suitable instrumentation governing ignitor means and perhaps steam-injection means located near the top of the stack.

Immediately after the flare may be caused to go out, gases within the flare stack system begin to cool down. Considering Charles' Law for gases at constant pressure (here open to atmosphere), $V1/V2 = T1/T2$, where $V1$ and $V2$ are the volumes of gas at absolute temperatures $T1$ and $T2$ respectively. If $V1$ and $T1$ represent volume and temperature respectively of a quantity of gas within a system, and $V2$ and $T2$ represent volume and temperature respectively of the same quantity at a lower temperature, from the rearranged equation $V2 = V1(T2/T1)$ it can be seen the volume of gas varies directly as the ratio of temperatures on the absolute scale. For example, if 1,000 cubic feet of gas within a flare stack system is at 260° C (533° K) and cools to 16° C (289° K), its volume is reduced to 1000 × (289/533) or 542 cubic feet.

Cooling of gases in the flare stack system and the resulting reduction in volume following burning allows air to be drawn into the flare stack opening and would therein mix and cause an explosive condition.

Types of flare stack assemblies for limiting the entry of air into a flare stack are disclosed in the following patents: U.S. Pat. No. 3,055,417, granted Sept. 25, 1962, and U.S. Pat. No. 3,289,729, granted Dec. 6, 1966.

To prevent dangerous explosive conditions within a flare stack system, air must be kept out during non-burning periods. The most common means for so doing includes the introduction near the lower end of the flare stack of commonly available purge gas such as methane (natural gas) at rates sufficient to maintain a slow upward flow within the stack and thus prevent downward flow of air. Of course, their use of natural gas is, except for the safety benefits, an energy waste as it escapes into atmosphere. Because the stacks are typically large in diameter, and to insure an always upward flow, however, slow, the amounts of natural gas used for this purpose are not insignifcant when viewed ecologically during this time of concern for energy conservation.

SUMMARY OF THE INVENTION

The present invention relates to an apparatus and method controlling the flow of gaseous materials in a waste flare system and more specifically to an apparatus and method preventing or limiting the volume of air that tends to enter the open top of a vertical flare stack when burning ceases and internal gases cool and reduce in volume. Further, an object of the invention pertains to an apparatus and method which by controlling and limiting the use of purge gas during non-burning times within the flare stack promotes safety conditions while conserving natural resources.

Another object of this invention provides a judicious use of an energy fuel such as natural gas, when used as a purge gas, so as to conserve the resource, allow minimal amounts released into the atmosphere for ecological reasons, and at the same time affording economic benefits.

It is a further object of the invention to reduce the amount of purge gas ordinarily used heretofore by monitoring the flow direction and directing only necessary and appropriate volumes of purge gas into the flare stack.

Other objects and features of the invention will become apparent with the consideration of the accompanying drawings and the detailed description which follows in the disclosure of one embodiment.

DETAILED DESCRIPTION

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1:
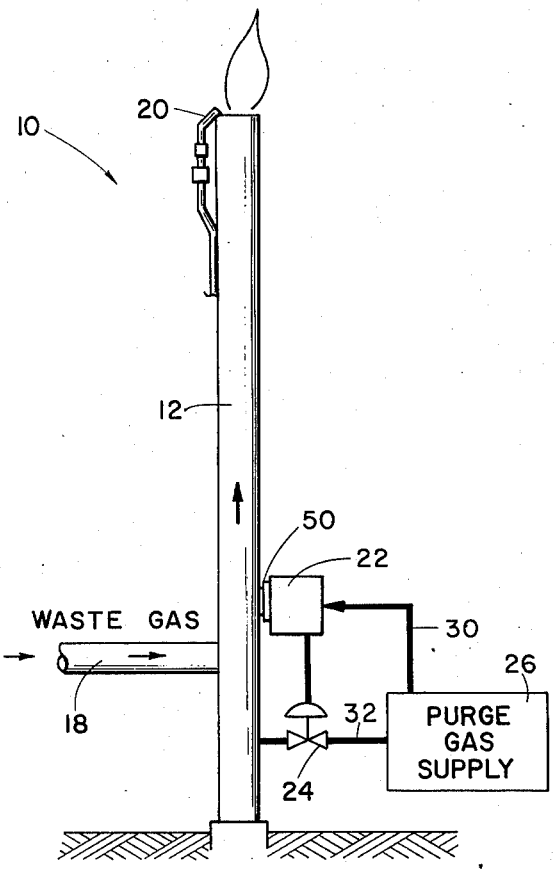
FIG. 1 is a diagramatic elevation view of a vertical flare stack system including a schematic showing of instrumentation and controls of this invention in association with the flare stack.

Referring to FIG. 1, an elevated vertical flare stack system, designated generally as 10, comprises a vertical tubular flare stack 12. Waste gases flow through piping 18 into the bottom portion of flare stack 12, thence upward and outward to atmosphere, being burned in a smokeless flare above the open top of stack 12 after ignition by pilot 20. Instrumentation, shown generally as 22 is located in the stack 12 at any point which is downstream of 18, monitors gas flow direction within stack 12 downstream of 18 and controls the opening of purge valve 24, which receives purge gas, e.g. methane (natural gas) from supply 26, via piping 32. Piping 30 directs the purge gas from supply 26 to control instrumentation 22. Purge line 32 carries purge gas from supply 26 to control valve 24 and thence, upon signal, into flare stack 12 near its bottom.

Figure 2:
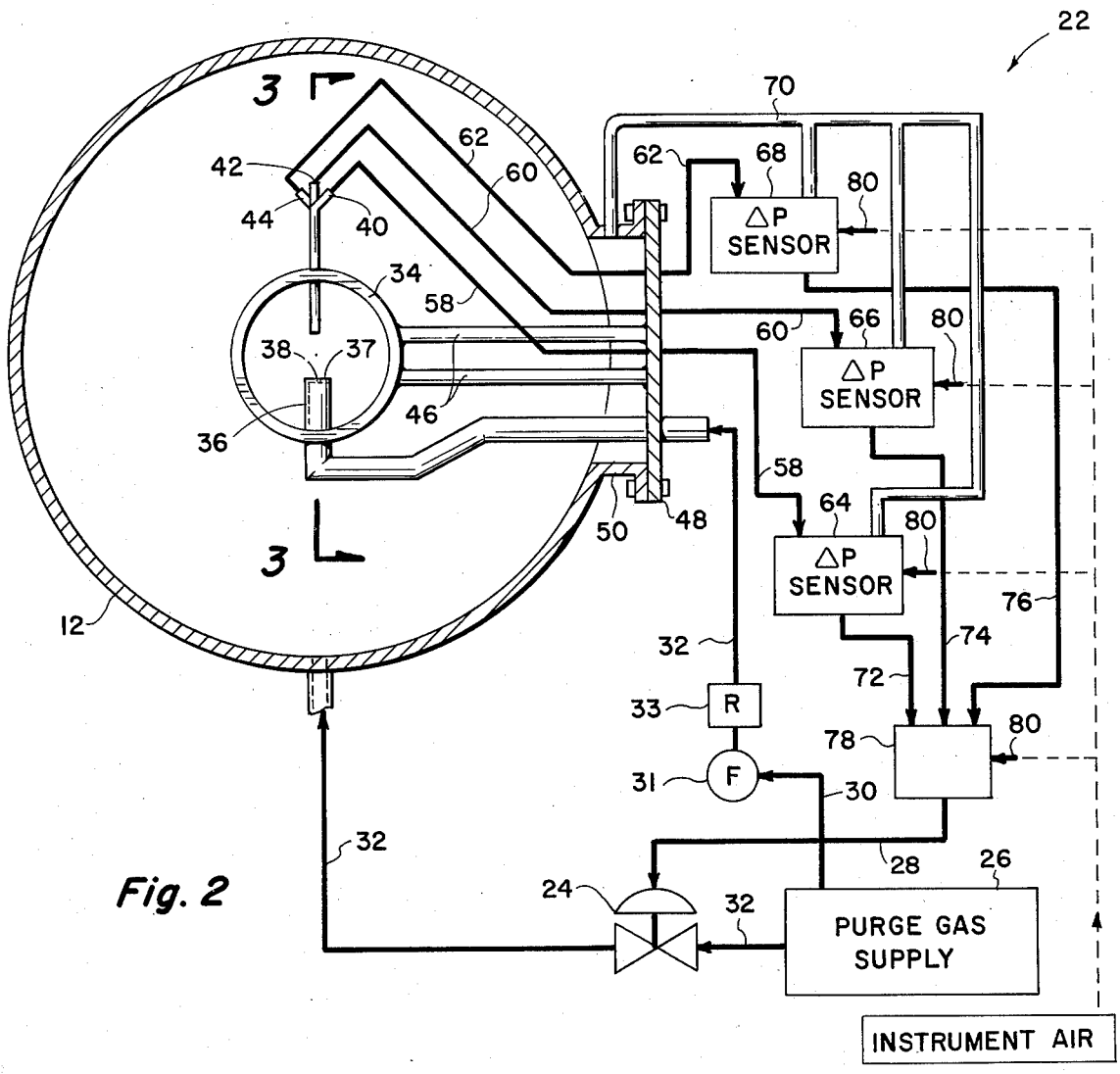
FIG. 2 is a top cross section view of the flare stack in conjunction with a schematic diagram of flow and pneumatic controls used in this invention.
Figure 3:
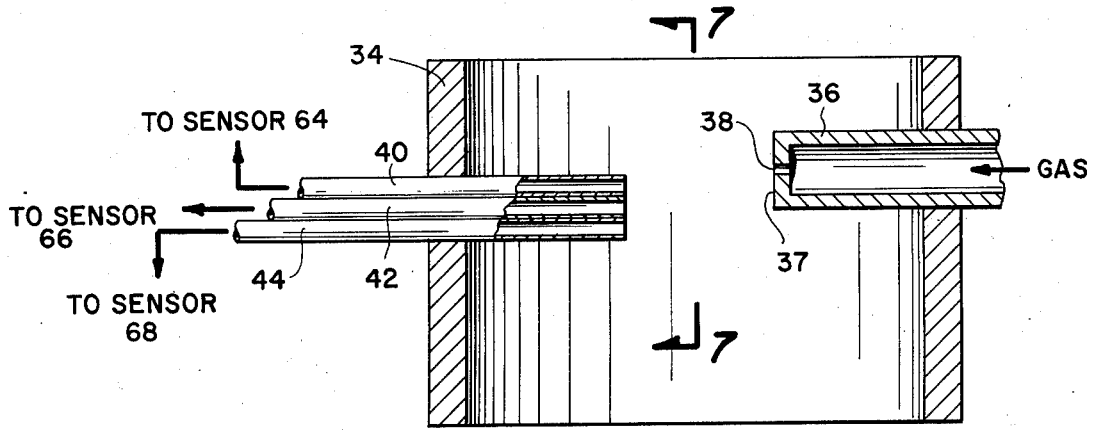
FIG. 3 is a fragmentary section taken inside the flare stack along the line 3—3 of FIG. 2.

Referring to FIGS. 2 and 3 is disposed vertical, tubular collar 34 held rigid by dual support rods 46 which are end-welded to both collar 34 and circular plate 48 bolted to and covering flanged port 50 in the wall of stack 12. Essentially, horizontal pipe 36 is disposed through the wall of collar 34 and has its end 37 directed radially toward the axis of collar 34. The end 37 is closed except for a small orifice 38. Vertically aligned horizontal impact receiving tubes 40, 42 and 44 are diametrically opposite to pipe 36 and pass through the wall of collar 34, with topmost tube 40 spaced slightly below the projected centerline of orifice 38. An order of magnitude example for these members would be a 1/32 inch diameter orifice 38 for ¼ inch nominal size pipe 36 while tubes 40, 42 and 44 could range from 1/16 inch to 3/32 inch inside diameter for a 24 inch nominal diameter of stack 12, collar 34 being 3 inch in diameter.

Referring particularly to FIG. 2, pipe 36 is in communication with gas supply 26, via line 30 which may include filter 31 and/or pressure regulator 33, causing a continuous gas jet 52 (See FIGS. 4, 5 and 6) to emerge from orifice 38. Pressure increment sensors 64, 66 and 68 are in open communication with tubes 40, 42 and 44 respectively via lines 58, 60 and 62 respectively, and with the interior of flanges port 50 of stack 12 via manifold 70, and are supplied instrument air via lines 80. The outlet ports of sensors 64, 66 and 68 are in communication with separate signal ports of pressure-regulating control valve 78 which is supplied power air via line 80. Valve 78 controls power air to combination shut-off and throttling valve 24 through which purge gas enters or not the bottom of stack 12 from supply 26 via line 32.

The system of tubes 40, 42 and 44, sensors 64, 66 and 68 and the corresponding connections, instrument air and control devices make up the normally constant pressure cells exposed to the gas flows within the flare stack.

Figure 4:
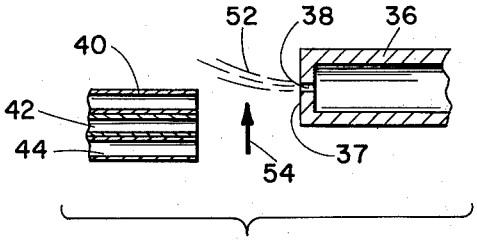
FIG. 4 is a fragmentary section of the gas jet arrangement shown during upward gas flow within the stack.
Figure 5:
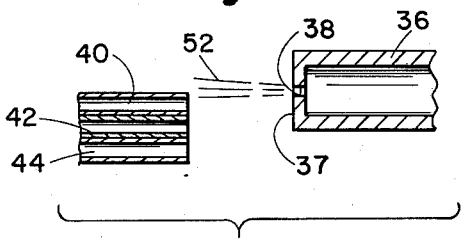
FIG. 5 is a fragmentary section of the gas jet arrangement shown during no-flow conditions.
Figure 6:
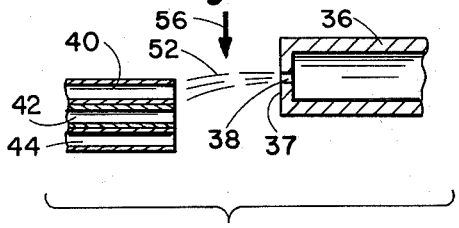
FIGS. 6, 7 and 8 are fragmentary sections of the gas jet arrangement shown during increasing inverted (downward) flow within the stack.
Figure 7:
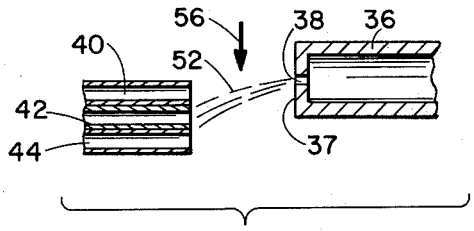
Figure 8:
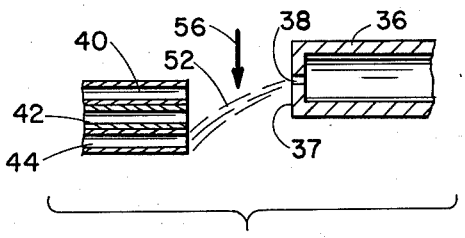
Figure 9:
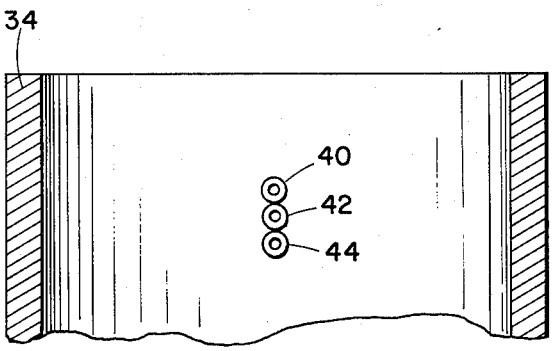
FIG. 9 is a fragmentary section taken along line 7—7 of FIG. 3.

FIGS. 4, 5 and 6 illustrate three operative conditions of gas flow within stack 12 (and therefore in collar 34). FIG. 4 shows a condition of upward gas flow, indicated by arrow 54, which deflects gas jet 52, emerging from orifice 38 of pipe 36 in a somewhat upward direction from horizontal path, so that it does not strike the open end of tube 40. FIG. 5 depicts a stagnant condition of zero vertical flow within stack 12, wherein gas jet 52 is generally horizontal and, because of its relative location, only partly strikes the open end of tube 40. FIG. 6 illustrates an inverted flow condition in stack 12 with downward flow, indicated by arrow 56, causing gas jet 52 to be deflected somehwat downward from horizontal and thus impinge fully and directly on the open end of tube 40. It can be further visualized, without the aid of additional figures, that increased rates of downward flow within stack 12 would cause gas jet 52 to be increasingly deflected downwardly from horizontal and strike in turn tubes 42 and 44 which are aligned vertically immediately beneath tube 40 as shown in FIG. 7.

In operation, during times when the flare is present, waste gas or emergency relief gas from refinery plants enters system 10 via piping 18 into the lower part of vertical elevated flare stack 12 and thence upward to be flared at the top of stack 12. This upward flow within stack 12 deflects constant gas jet 52 upward and away from the open ends of tubes 40, 42 and 44 located across from pipe 36 within collar 34. Hence, a condition of "no signal" to instrumentation (22) exists in this instance, purge valve 24 remains in its normally closed position, and thus no purge gas from supply 26 will enter stack 12.

During infrequent times when waste gases are no longer present and necessarily vented to atmosphere and the flare is extinguished, gases remaining within stack 12 and openly communicative areas of system 10 will begin to cool and reduce in volume as previously explained. Flow direction within stack 12 will thereafter change from upward to stagnation (zero flow) to downward (inverted flow). As this occurs, gas jet 52 will change its direction respectively from that of upward to horizontal and from there to one of being deflected downward from horizontal in varying degrees, dependent upon the rate of inverted flow within stack 12. It is to be noted here that collar 34 might be located vertically in any horizontal planar location within the stack 12 cross-section. However, because low flow rates within a pipe such as stack 12 are laminar rather than turbulent, and the roughness of internal pipe walls cause friction which retards flow, there is a laminar flow rate gradient from a minimum at the pipe wall to a maximum at the pipe axis. Collar 34 is at a coaxial and central location.

In most flare stacks there is a flanged connection of the vertical riser with that member which includes the tip. Typically, this latter member is about 12 feet long. The collar 34 can be located at any point, vertically, above 18 in stack 12 and below the flare tip attachment to 12 and FIG. 1 shows a typical location for 34–22.

As gas jet 52 begins to strike the open end of tube 40, it increases pressure within tube 40 by virtue of its impact energy or velocity-head ($v^2/2g$, where $v$ is flow velocity in feet per second and $g$ is the acceleration due to gravity in feet per second.). Velocity head commonly is expressed in units of pressure, such as inches water column or as pounds per square inch. Here we deal with gas impact pressure (velocity-head) and the pressure unit is inches water-column. The impact pressure exists in 40, 42 and 44 as is to be seen. This increased pressure within tube 40, being in open communicaion with sensor 64 which compares pressures from tube 40 and port 50, causes sensor 64 to release a signal of instrument air, available from line 69, to control valve 78 via line 72. Upon such signal, valve 78 regulates a pre-set pressure, available from power air via line 80, and directs it to purge valve 24 causing it to open a pre-set amount and allow a rate of flow of purge gas from supply 26 to pass through line 32 and into the bottom of stack 12 and thence upward so as to reverse the undesirable inverted flow which would have otherwise brought in air from the atmosphere.

If the in-rush of air at the top of stack 12 is great enough to cause jet 52 to be deflected downward so as to impinge upon the open end of tube 42 rather than tube 40, the therein increased pressure transmitted by ine 60 will signal differential pressure sensor 66 to elease instrument air from line 80 to a second signal ort or valve 78 causing it to send a different preset ressure, this one greater than the first, to valve 24 which opens a greater amount and allows a greater flow of purge gas from supply 26 through line 32 into stack 12, and thereby more quickly preventing inverted flow n stack 12.

Similarly, an even greater rush of air downward into he top of stack 12 would deflect jet 52 towards the pen end of tube 44, rather than tubes 40 or 42, would result in sensor 68 (being in open communication with ube 44 via line 62) sending a signal of instrument air rom line 80 to a third signal port of valve 78 causing it o send a third preset pressure, this one the greatest, to valve 24 which opens a third and greatest preset amount to allow the highest flow rate of purge gas from supply 26 to stack 12 and upward therein to overcome he sudden inverted flow.

In each instance of signal, once the downward flow rate within stack 12 has been retarded, the instrumentation 22 allows valve 24 to reduce flow of purge gas to only that necessary for safety. When upward flow within stack 12 is reestablished, no signals are given and valve 24 will again close and prevent unnecessary waste of purge gas. Suitable delays, not shown, may be included in the instrumentation to prevent rapid fluctuations on controls.

As mentioned, the gas flow from orifice 38 of pipe 36 must be continuous to maintain proper monitorying conditions, but the volume of natural gas flowing through the 1/32 inch diameter orifice 38 is small, i.e. on the order of 2 percent of that typically now used to avoid inverted flow in common sized flare stacks. Inverted flow is a real and potentially dangerous problem in any flare stack at a refinery or other process plant disposing of waste hydrocarbons, proof of the fact being that it is now constantly guarded against with the introduction of continuous flow of purge gas, even though the times during which air enters stacks is a minority of time and in some instances rare. Therefore, this invention may save up to approximately 98 percent of purge gas that would have otherwise been used for this purpose.

What is claimed:

1. A method of regulating the amount of purge gas into a vertical flare stack comprising the steps of:

directing a small high velocity stream of purge gas transversely to the flow of gas in said stack;

detecting the deflection of said high velocity stream; and regulating the amount of purge gas as a function of said deflection.

2. The method of claim 1 where the step of detecting includes the steps of:

maintaining a pressure sensing means opposite but below said high velocity stream;

detecting changes in the pressure of said sensing means due to the downward deflection of said high velocity stream impacting upon said means; and utilizing said change to cause injection of said purge gas into said stack to cause an upward deflection of said high velocity stream.

3. A method of regulating the supply of purge gas into the base of a vertical gas flare stack comprising the steps of:

continuously directing a small high velocity stream of purge gas transversely to the flow of gas in the stack;

maintaining diametrically opposite but vertically aligned below the transverse axis of the high velocity stream, a plurality of pressure sensing means;

detecting changes in the pressure of said means due to any downward deflection of the high velocity stream and its impacting upon each of said means; and utilizing said pressure change in said means to produce a corresponding signal for each cell;

introducing the purge gas in response to the signal such that as the downward deflection increases there is a corresponding increase in the supply of purge gas and vice-versa.

4. Method of claim 3 where said pressure sensing means includes the steps of:

maintaining and exposing a substantially constant reference pressure to said cell, creating, with changes in the pressure caused by the downward deflection of the high velocity stream, signals proportionate to the severity of the deflection; and utilizing the signals to introduce the purge gas proportionately to the severity of the deflection.

5. The method of claim 3 wherein the purge gas introduced is a non-condensable gas at typical temperature and pressure.

6. Apparatus to control the quantities of purge gas into a vertical flare stack to prevent air entry and inversion into said stack, comprising:

a collar supported within said stack;

a pipe supported in said collar having a small orifice at the end, the axis of which is horizontal to the vertical flow of gases in said stack;

means to constantly supply a gas to said pipe;

a plurality of impact receiving tubes vertically supported in said collar diamterically opposite but below the axis of said orifice;

differential pressure sensing apparatus connected to each impact receiving tube;

a purge gas supply conduit to said stack;

a pressure regulating valve to control flow of said purge gas to said conduit; and signal means interconnecting changes in each of said differential pressure sensing apparatus with said pressure regulating control whereby increasing downflow velocity of gases in said stack can increase the amount of purge gas flow into said stack and vice-vera.

7. Apparatus of claim 6 wherein said collar is centrally and coaxially located in said stack.

* * * * *